US011015599B2

(12) United States Patent
Yamashita et al.

(10) Patent No.: US 11,015,599 B2
(45) Date of Patent: May 25, 2021

(54) CO-ROTATING SCROLL COMPRESSOR AND METHOD FOR DESIGNING THE SAME

(71) Applicant: MITSUBISHI HEAVY INDUSTRIES, LTD., Chiyoda-ku (JP)

(72) Inventors: Takuma Yamashita, Tokyo (JP); Takahide Ito, Tokyo (JP); Makoto Takeuchi, Tokyo (JP); Keita Kitaguchi, Tokyo (JP); Hirofumi Hirata, Aichi (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 181 days.

(21) Appl. No.: 16/322,041

(22) PCT Filed: Aug. 1, 2017

(86) PCT No.: PCT/JP2017/027940
§ 371 (c)(1),
(2) Date: Jan. 30, 2019

(87) PCT Pub. No.: WO2018/025878
PCT Pub. Date: Feb. 8, 2018

(65) Prior Publication Data

US 2019/0162184 A1 May 30, 2019

(30) Foreign Application Priority Data

Aug. 1, 2016 (JP) ..... JP2016-151545

(51) Int. Cl.
*F04C 2/10* (2006.01)
*F04C 15/06* (2006.01)
(Continued)

(52) U.S. Cl.
CPC ..... *F04C 18/023* (2013.01); *F04C 18/0269* (2013.01); *F04C 29/00* (2013.01);
(Continued)

(58) Field of Classification Search
CPC ..... F04C 2/10; F04C 15/06; F04C 18/023; F04C 18/0238; F04C 18/0246;
(Continued)

(56) References Cited

U.S. PATENT DOCUMENTS 3,600,114 A 8/1971 Dvorak et al.
4,756,675 A 7/1988 Kakuda et al.
(Continued)

FOREIGN PATENT DOCUMENTS

CN 102777382 A 11/2012
CN 103375174 A 10/2013
(Continued)

OTHER PUBLICATIONS

Chinese Office Action and Search Report, dated Sep. 12, 2019, for Chinese Application No. 201780047914.5, with an English translation.

*Primary Examiner* — Deming Wan
(74) *Attorney, Agent, or Firm* — Birch, Stewart, Kolasch & Birch, LLP

(57) ABSTRACT

A co-rotating scroll compressor includes a driving-side scroll member (7), a driven-side scroll member (9), a pin ring mechanism (15), a driving-side bearing (11) that rotatably supports the driving-side scroll member (7), and a driven-side bearing (13) that rotatably supports the driven-side scroll member (9). A center of gravity of at least one of the driving shaft (6), the driving-side scroll member (7), and the driven-side scroll member (9) is shifted from rotation centers (CL1, CL2) by a predetermined distance. The predetermined distance is set so that a total bearing load
(Continued)

obtained by centrifugal force and fluid compression that is 5% of a dynamic load rating of the driving-side bearing (11) and the driven-side bearing (13) or more is generated.

4 Claims, 7 Drawing Sheets

(51) Int. Cl.

| | |
|---|---|
| ***F04C 18/02*** | (2006.01) |
| ***F01C 1/02*** | (2006.01) |
| ***F03C 2/02*** | (2006.01) |
| ***F04C 2/02*** | (2006.01) |
| ***F04C 2/00*** | (2006.01) |
| ***F04C 29/00*** | (2006.01) |

(52) U.S. Cl.
CPC ..... *F04C 29/0021* (2013.01); *F04C 29/0057* (2013.01); *F04C 29/0085* (2013.01); *F04C 2230/603* (2013.01); *F04C 2240/50* (2013.01); *F04C 2240/60* (2013.01); *F04C 2240/807* (2013.01)

(58) Field of Classification Search
CPC ..... F04C 18/02; F04C 18/0215; F04C 2/02; F04C 2240/02; F04C 23/008; F04C 29/0021; F01C 1/02; F01C 1/0238; F03C 2/02
See application file for complete search history.

(56) References Cited

U.S. PATENT DOCUMENTS

| | | | | |
|---|---|---|---|---|
| 5,066,206 | A * | 11/1991 | Kakuda | F01C 17/06 418/55.3 |
| 5,490,769 | A * | 2/1996 | Calhoun | F04C 18/023 418/1 |
| 7,445,437 | B1 * | 11/2008 | Kawazoe | F04C 18/02 418/55.1 |
| 9,316,224 | B2 * | 4/2016 | Unami | F04C 18/00 |
| 10,001,122 | B2 | 6/2018 | Uekawa | |
| 2006/0171830 | A1 * | 8/2006 | Takei | F04C 29/0021 418/55.3 |
| 2012/0288393 | A1 | 11/2012 | Sato | |
| 2013/0302199 | A1 | 11/2013 | Unami et al. | |
| 2014/0227117 | A1 | 8/2014 | Uekawa | |
| 2016/0123147 | A1 * | 5/2016 | Fujioka | F01C 17/06 418/55.1 |

FOREIGN PATENT DOCUMENTS

| | | | |
|---|---|---|---|
| CN | 103814219 | A | 5/2014 |
| JP | S63-9691 | A | 1/1988 |
| JP | H02-140484 | A | 5/1990 |
| JP | 5443132 | B2 | 3/2014 |

* cited by examiner

CO-ROTATING SCROLL COMPRESSOR AND METHOD FOR DESIGNING THE SAME

TECHNICAL FIELD

The present invention relates to a co-rotating scroll compressor and a method for designing the co-rotating scroll compressor.

BACKGROUND ART

Hitherto, a co-rotating scroll compressor is known (see PTL 1). The co-rotating scroll compressor includes a driving-side scroll and a driven-side scroll that rotates together with and in synchronization with the driving-side scroll. The co-rotating scroll compressor rotates the driving shaft and the driven shaft in the same direction at the same angular velocity by offsetting a driven shaft that supports the rotation of the driven-side scroll from a driving shaft that rotates the driving-side scroll by the turning radius.

CITATION LIST

Patent Literature

[PTL 1]
the Publication of Japanese Patent No. 5443132

SUMMARY OF INVENTION

Technical Problem

Even when the size of a bearing can be reduced by causing the center of gravity of the scrolls to match the rotation center as in PTL 1, there is a need to secure the diameter of the bearing to be equal to or more than a predetermined value when an exhaust port is formed in a rotating shaft, for example. In the case as above, there is a fear that the load applied to the bearing becomes insufficient for the size of the bearing, slippage occurs between the bearing and a member to which the bearing is attached, and the life of the bearing is reduced.

The present invention has been made in view of the situation as above, and an object thereof is to provide a co-rotating scroll compressor capable of extending the life of a bearing, and a method for designing the co-rotating scroll compressor.

Solution to Problem

In order to solve the abovementioned problems, a co-rotating scroll compressor and a method for designing the co-rotating scroll compressor of the present invention employ the following solutions.

That is, a co-rotating scroll compressor according to an aspect of the present invention includes: a driving shaft driven by a drive unit so as to rotate; a driving-side scroll member connected to the driving shaft, and including a plurality of spiral driving-side walls provided about a center of a driving-side end plate at predetermined angular intervals; a driven-side scroll member including spiral driven-side walls, the driven-side walls being provided about a center of a driven-side end plate at predetermined angular intervals and in a number corresponding to the driving-side walls, the driven-side walls being engaged with the corresponding driving-side walls so as to form a compression space; a synchronous driving mechanism that transmits driving force from the driving-side scroll member to the driven-side scroll member so that the driving-side scroll member and the driven-side scroll member rotationally move in a same direction at a same angular velocity; a driving-side bearing that rotatably supports the driving-side scroll member; and a driven-side bearing that rotatably supports the driven-side scroll member. In the co-rotating scroll compressor, a center of gravity of at least one of the driving shaft, the driving-side scroll member, or the driven-side scroll member is shifted from a rotation center by a predetermined distance, and the predetermined distance is set so that a total bearing load obtained by centrifugal force and fluid compression that is 5% of a dynamic load rating of the driving-side bearing and/or the driven-side bearing or more is generated.

The driving-side walls arranged about the center of the end plate of the driving-side scroll member at predetermined angular intervals and the corresponding driven-side walls of the driven-side scroll member are engaged with each other. As a result, a plurality of pairs each formed by one driving-side wall and one driven-side are provided, and the scroll-type compressor including a plurality of lines of walls is formed. The driving-side scroll member is driven by the drive unit so as to rotate, and the driving force transmitted to the driving-side scroll member is transmitted to the driven-side scroll member via the synchronous driving mechanism. As a result, the driven-side scroll member rotationally moves in the same direction at the same angular velocity as the driving-side scroll member while rotating. As described above, the double rotating-type scroll-type compressor in which both of the driving-side scroll member and the driven-side scroll member rotate is provided.

When a plurality of the walls are provided, the walls can be symmetrically arranged about the rotation center of the scroll members, and hence the center of gravity and the rotation center of the scroll members are usually caused to match each other. However, when the center of gravity and the rotation center of the scroll members are caused to match each other, the load applied to the bearings decreases. Therefore, slippage occurs between the bearings and the members attached to the bearings, and the life of the bearings decreases. Thus, the center of gravity of at least one of the driving shaft, the driving-side scroll member, and the driven-side scroll member is shifted from the rotation center by a predetermined distance, to thereby generate centrifugal force and cause a predetermined load to be applied to the bearings. As a result, the life of the bearings can be extended.

The predetermined distance by which the center of gravity is shifted from the rotation center is set so that a total bearing load obtained by the centrifugal force and the fluid compression that is 5% of the dynamic load rating of the bearings or more is generated at the rated speed, for example.

Note that the force to be generated is preferably set to be 10% of the dynamic load rating of the bearings or less.

Further, in the co-rotating scroll compressor according to an aspect of the present invention, the predetermined distance is set so that a load to which a preload applied to the driving-side bearing and/or the driven-side bearing is added is 5% of the dynamic load rating or more.

There are cases where a load is applied to the bearings in advance by applying a preload to the bearings. In the case as above, the centrifugal force to be generated in accordance with the predetermined distance is determined by taking the load applied by the preload into consideration.

Further, in the co-rotating scroll compressor according to an aspect of the present invention, at least one of the plurality of driving-side walls and/or the plurality of driven-side walls is shifted from a position that is symmetrical to a rotation center.

By shifting the walls from positions that are symmetrical to the rotation center, the center of gravity can be shifted from the rotation center.

In addition, parts of the end plates that do not form the compression chamber may be cut off, or additional heavy loads may be locally provided on the end plates. Further, a part of the driving shaft may be cut off, or an additional heavy load may be locally provided on the driving shaft.

Further, the co-rotating scroll compressor according to an aspect of the present invention further includes: a driving-side supporting member arranged across the driven-side end plate, fixed to distal sides of the driving-side walls in a rotating shaft direction, and rotated together with the driving-side scroll member; and/or a driven-side supporting member arranged across the driving-side end plate, fixed to distal end sides of the driven-side walls in a rotating shaft direction, and rotated together with the driven-side scroll member. In the co-rotating scroll compressor, a center of gravity of the driving-side supporting member and/or the driven-side supporting member is shifted from a rotation center.

When the driving-side supporting member and the driven-side supporting member are included, the centrifugal force may be adjusted by shifting the center of gravity of those supporting members.

In addition, in a method for designing a co-rotating scroll compressor according to an aspect of the present invention, the co-rotating scroll compressor includes: a driving shaft driven by a drive unit so as to rotate; a driving-side scroll member connected to the driving shaft, and including a plurality of spiral driving-side walls provided about a center of a driving-side end plate at predetermined angular intervals; a driven-side scroll member including spiral driven-side walls, the driven-side walls being provided about a center of a driven-side end plate at predetermined angular intervals and in a number corresponding to the driving-side walls, the driven-side walls being engaged with the corresponding driving-side walls so as to form a compression space; a synchronous driving mechanism that transmits driving force from the driving-side scroll member to the driven-side scroll member so that the driving-side scroll member and the driven-side scroll member rotationally move in a same direction at a same angular velocity; a driving-side bearing that rotatably supports the driving-side scroll member; and a driven-side bearing that rotatably supports the driven-side scroll member. The method includes: shifting a center of gravity of at least one of the driving shaft, the driving-side scroll member, or the driven-side scroll member from a rotation center by a predetermined distance; and setting the predetermined distance so that a total bearing load obtained by centrifugal force and fluid compression that is 5% of a dynamic load rating of the driving-side bearing and/or the driven-side bearing or more is generated.

Advantageous Effects of Invention

The predetermined load is applied to the bearing by generating the centrifugal force by shifting the center of gravity of at least one of the driving shaft, the driving-side scroll member, and the driven-side scroll member from the rotation center by the predetermined distance, and hence the life of the bearing can be extended.

DESCRIPTION OF EMBODIMENTS

Embodiments according to the present invention are described below with reference to the drawings.

First Embodiment

A first embodiment of the present invention is described below with reference to FIG. 1 and the like.

Figure 1:
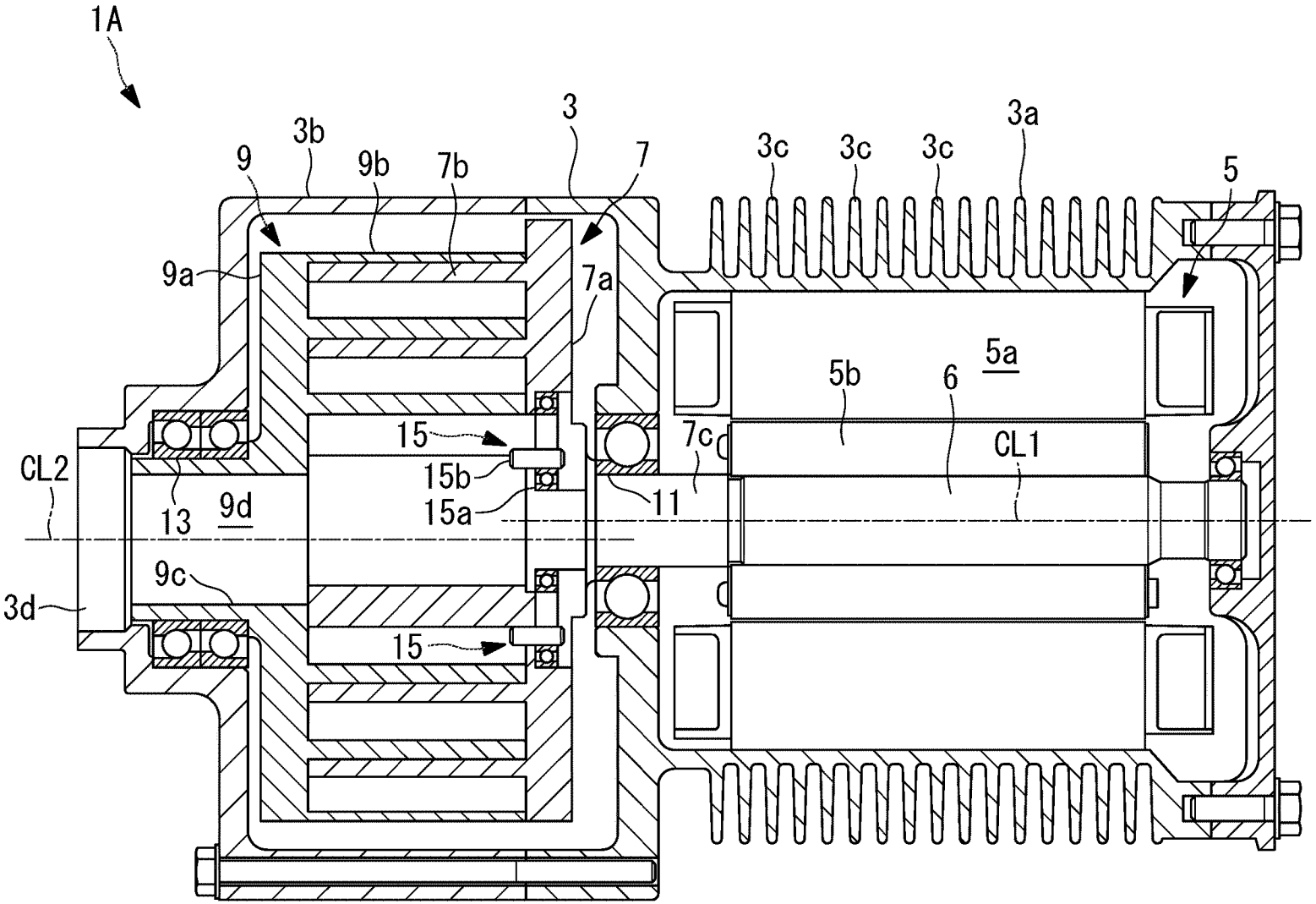
FIG. 1 is a longitudinal cross-sectional view illustrating a co-rotating scroll compressor according to a first embodiment of the present invention.

FIG. 1 illustrates a co-rotating scroll compressor 1A. The co-rotating scroll compressor 1A can be used as a supercharger that compresses combustion air (fluid) to be supplied to an internal combustion engine such as a vehicle engine, for example.

The co-rotating scroll compressor 1A includes a housing 3, a motor (drive unit) 5 accommodated in one end side of the housing 3, and a driving-side scroll member 7 and a driven-side scroll member 9 accommodated in the other end side of the housing 3.

The housing 3 has a substantially cylindrical shape, and includes a motor accommodation portion 3*a* that accommodates the motor 5, and a scroll accommodation portion 3*b* that accommodates the scroll members 7 and 9.

Cooling fins 3*c* for cooling the motor 5 are provided on the outer periphery of the motor accommodation portion 3*a*. An exhaust opening 3*d* for exhausting air that has been compressed is formed in end portion of the scroll accommodation portion 3*b*. Note that, although not shown in FIG. 1, an air suction opening that sucks air is provided in the housing 3.

The motor 5 is driven by being supplied with electric power from a power supply source (not shown). The rotation control of the motor 5 is performed in accordance with instructions from a control unit (not shown). A stator 5*a* of the motor 5 is fixed to the inner peripheral side of the housing 3. A rotor 5*b* of the motor 5 rotates about a driving-side rotational axis CL1. A driving shaft 6 extending on the driving-side rotational axis CL1 is connected to the rotor 5*b*. The driving shaft 6 is connected to the driving-side scroll member 7.

The driving-side scroll member 7 includes a driving-side end plate 7*a*, and a spiral driving-side wall 7*b* provided on one side of the driving-side end plate 7*a*. The driving-side end plate 7*a* is connected to the driving-side shaft portion 7*c* connected to a driving shaft 6, and extends in a direction orthogonal to the driving-side rotational axis CL1. The driving-side shaft portion 7*c* is provided so as to be rotatable with respect to the housing 3 via a driving-side bearing 11 that is a ball bearing.

Figure 2:
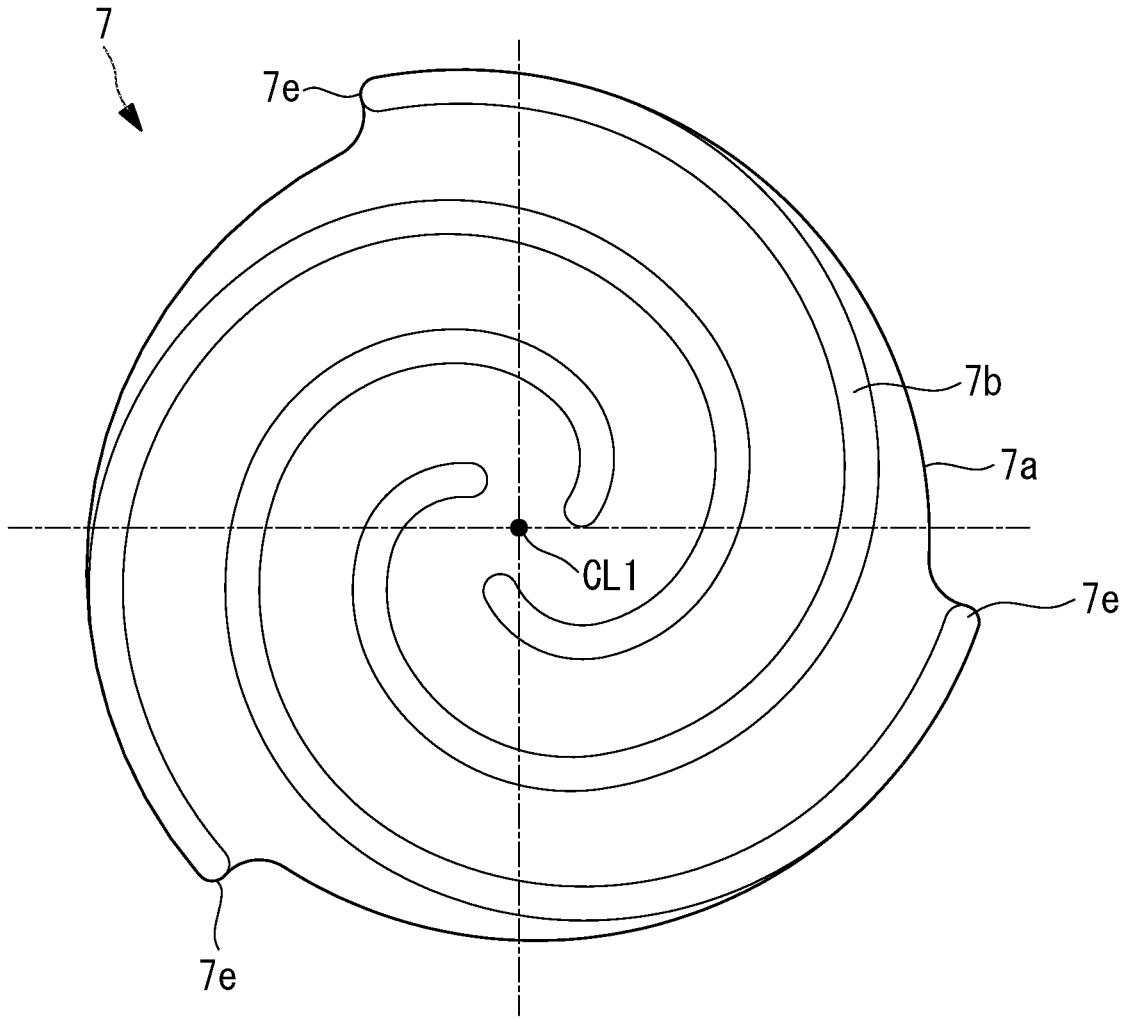
FIG. 2 is a plan view illustrating a driving-side scroll member in FIG. 1.

As illustrated in FIG. 2, the driving-side end plate 7*a* has a substantially disk-like shape when seen in planar view. The driving-side scroll member 7 includes three spiral driving-side walls 7*b*, that is, three lines of spiral driving-side walls 7*b*. The three lines of driving-side walls 7*b* are provided about the driving-side rotational axis CL1 at regular intervals. Note that at least one of the three driving-side walls 7*b* is shifted from a symmetrical position about the driving-side rotational axis CL1 by a predetermined distance. As a result, the center of gravity of the driving-side scroll member 7 is shifted from the driving-side axis CL1 that is the rotation center, and centrifugal force is generated. As a result, the centrifugal force is applied to the driving-side bearing 11 as a load.

Winding end portions 7*e* of the driving-side walls 7*b* are not fixed to other wall portions and are independent. That is, wall portions that connect the winding end portions 7*e* to each other so as to provide reinforcement are not provided.

As illustrated in FIG. 1, the driven-side scroll member 9 is arranged so as to engage with the driving-side scroll member 7, and includes a driven-side end plate 9*a* and a spiral driven-side wall 9*b* provided on one side of the driven-side end plate 9*a*. A driven-side shaft portion 9*c* that extends in the direction of a driven-side rotational axis CL2 is connected to the driven-side end plate 9*a*. The driven-side shaft portion 9*c* is provided so as to be rotatable with respect to the housing 3 via a driven-side bearing 13 that is a double row ball bearing.

Figure 3:
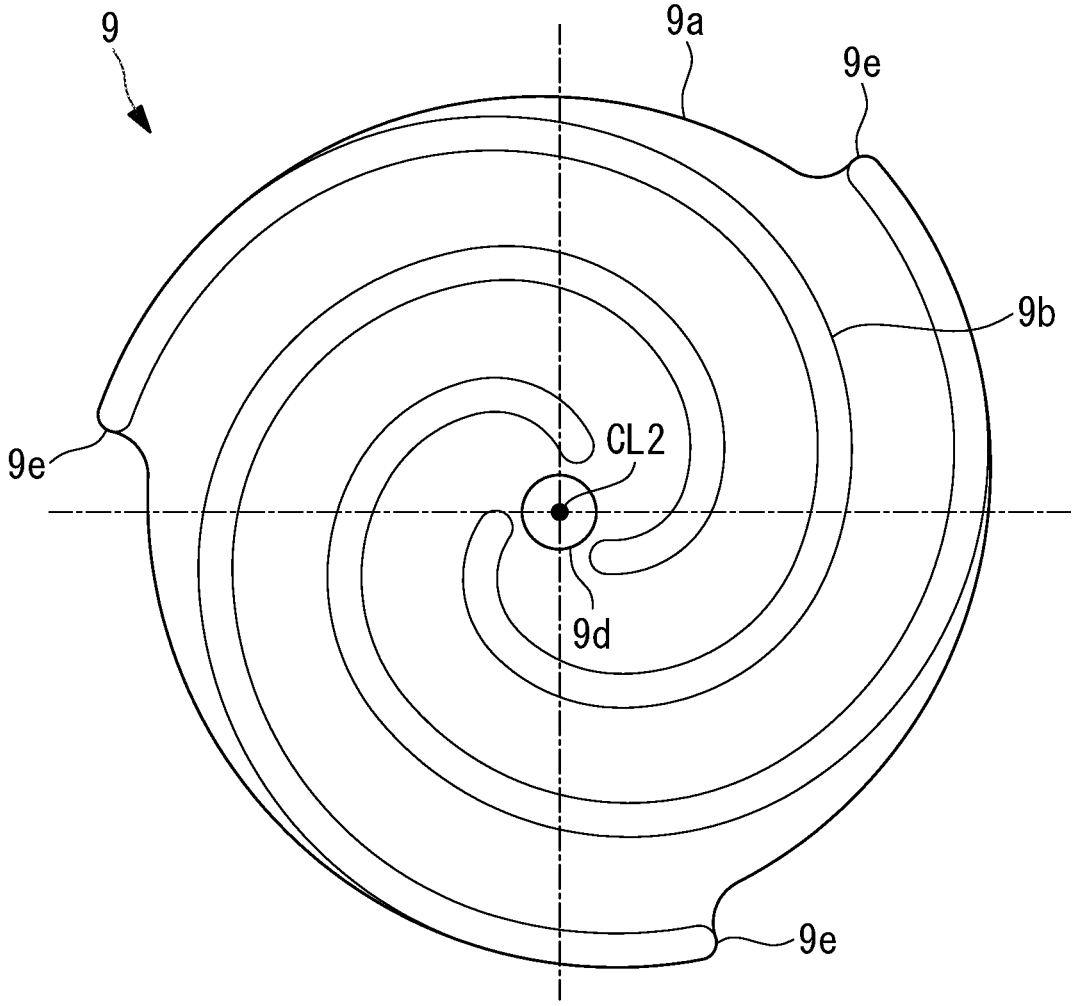
FIG. 3 is a plan view illustrating a driven-side scroll member in FIG. 1.

As illustrated in FIG. 3, the driven-side end plate 9*a* has a substantially disk-like shape when seen in planar view. Three spiral driven-side walls 9*b*, that is, three lines of spiral driven-side walls 9*b* are provided in the driven-side scroll member 9. The three lines of driven-side walls 9*b* are arranged about the driven-side rotational axis CL2 at regular intervals. Note that at least one of the three driven-side walls 9*b* is shifted from a symmetrical position about the driven-side rotational axis CL2 by a predetermined distance. As a result, the center of gravity of the driven-side scroll member 9 is shifted from the driving-side rotational axis CL1 that is the rotation center, and centrifugal force is generated. As a result, the centrifugal force is applied to the driven-side bearing 13 as a load.

An exhaust port 9*d* that exhausts air that has been compressed is formed in substantially the middle of the driven-side end plate 9*a*. The exhaust port 9*d* communicates with the exhaust opening 3*d* formed in the housing 3. Winding end portions 9*e* of the driven-side walls 9*b* are not fixed to the other wall portions and are independent. That is, wall portions that connect the winding end portions 9*e* to each other so as to provide reinforcement are not provided.

As described above, as illustrated in FIG. 1, the driving-side scroll member 7 rotates about the driving-side rotational axis CL1 and the driven-side scroll member 9 rotates about the driven-side rotational axis CL2. The driving-side rotational axis CL1 and the driven-side rotational axis CL2 are offset from each other by a distance with which a compression chamber can be formed.

A plurality of pin ring mechanisms 15 are provided between the driving-side scroll member 7 and the driven-side scroll member 9. The pin ring mechanism 15 is used as a synchronous driving mechanism that transmits driving force from the driving-side scroll member 7 to the driven-side scroll member 9 so that both of the scroll members 7 and 9 rotationally move in the same direction at the same angular velocity. Specifically, as illustrated in FIG. 1, the pin ring mechanism 15 includes a ring member 15*a* that is a ball bearing, and a pin member 15*b*. The ring member 15*a* is fixed in a state in which an outer ring is fitted in a hole portion formed in the driving-side end plate 7*a*. The pin member 15*b* is fixed in a state of being inserted in a mounting hole formed in a distal end (the right end in FIG. 1) of the driven-side wall 9*b*. Note that, in FIG. 1, the state in which the pin member 15*b* is inserted in the distal end of the driven-side wall 9*b* is not clearly illustrated due to the position along which FIG. 1 is taken in the illustration, and only the pin member 15*b* is illustrated for the ease of understanding. When a side portion of a distal end of the pin member 15*b* moves while being in contact with an inner peripheral surface of an inner ring of the ring member 15*a*, rolling motion in the same direction at the same angular velocity is realized.

The co-rotating scroll compressor 1A having the above-mentioned configuration operates as follows.

When the driving shaft 6 is rotated about the driving-side rotational axis CL1 by the motor 5, the driving-side shaft portion 7*c* connected to the driving shaft 6 also rotates. As a result, the driving-side scroll member 7 rotates about the driving-side rotational axis CL1. When the driving-side scroll member 7 rotates, the driving force is transmitted to the driven-side scroll member 9 via the pin ring mechanism 15, and the driven-side scroll member 9 rotates about the driven-side rotational axis CL2. At this time, the pin member 15*b* of the pin ring mechanism 15 moves while being in contact with the ring member 15*a*, and hence both of the scroll members 7 and 9 rotationally move in the same direction at the same angular velocity.

When both of the scroll members 7 and 9 rotationally and pivotally move, the air sucked from the suction opening in the housing 3 is sucked from the outer periphery side of both of the scroll members 7 and 9, and is taken into the compression chamber formed by both of the scroll members 7 and 9. The capacity of the compression chamber decreases as the compression chamber approaches the center side, and air is compressed accordingly. The air compressed as above flows through the exhaust port 9*d* in the driven-side scroll member 9 and is exhausted to the outside from the exhaust opening 3*d* in the housing 3.

The effects of this embodiment are as follows.

When a plurality of the walls 7*b* and 9*b* are provided, the walls 7*b* and 9*b* can be symmetrically arranged about the rotation center of the scroll members 7 and 9, and hence the center of gravity and the rotation center of the scroll members 7 and 9 are usually caused to match each other. However, when the center of gravity and the rotation center of the scroll members 7 and 9 are caused to match each other, the load applied to the bearings 11 and 13 decreases. Therefore, slippage occurs between the bearings 11 and 13 and the members on the housing 3 side attached to the bearings 11 and 13, and the life of the bearings 11 and 13 decreases. Thus, the center of gravity of at least one of the walls 7*b* and 9*b* that are each formed of three lines is shifted from the rotation center by a predetermined distance, to thereby generate centrifugal force and cause a predetermined load to be applied to the bearings 11 and 13. The predetermined distance by which the center of gravity is shifted from the rotation center is set so that a total bearing load obtained by the centrifugal force and the fluid compression that is 5% of the dynamic load rating of the bearings 11 and 13 or more is generated at the rated speed, for example. As a result, the life of the bearings 11 and 13 can be extended.

As in this embodiment, the diameter is desired to be increased for the bearing 13 supporting the shaft portion 9*c* in which the exhaust port 9*d* is formed in order to cause the pressure loss at the exhaust port 9*d* to be as small as possible. In the case as above, the diameter of the bearing 13 becomes large, but the occurrence of slippage can be avoided because load is applied by the centrifugal force.

Note that there are cases where a load is applied to the bearings 11 and 13 in advance by applying a preload to the bearings 11 and 13. In the case as above, the centrifugal force to be generated in accordance with the predetermined distance is determined by taking the load applied by the preload into consideration.

In addition, parts of the end plates 7*a* and 9*a* that do not form the compression chamber may be cut off, or additional heavy loads may be locally provided on the end plates 7*a* and 9*a*. Further, a part of the driving shaft 6 may be cut off, or an additional heavy load may be locally provided on the driving shaft 6.

First Modification

Figure 4:
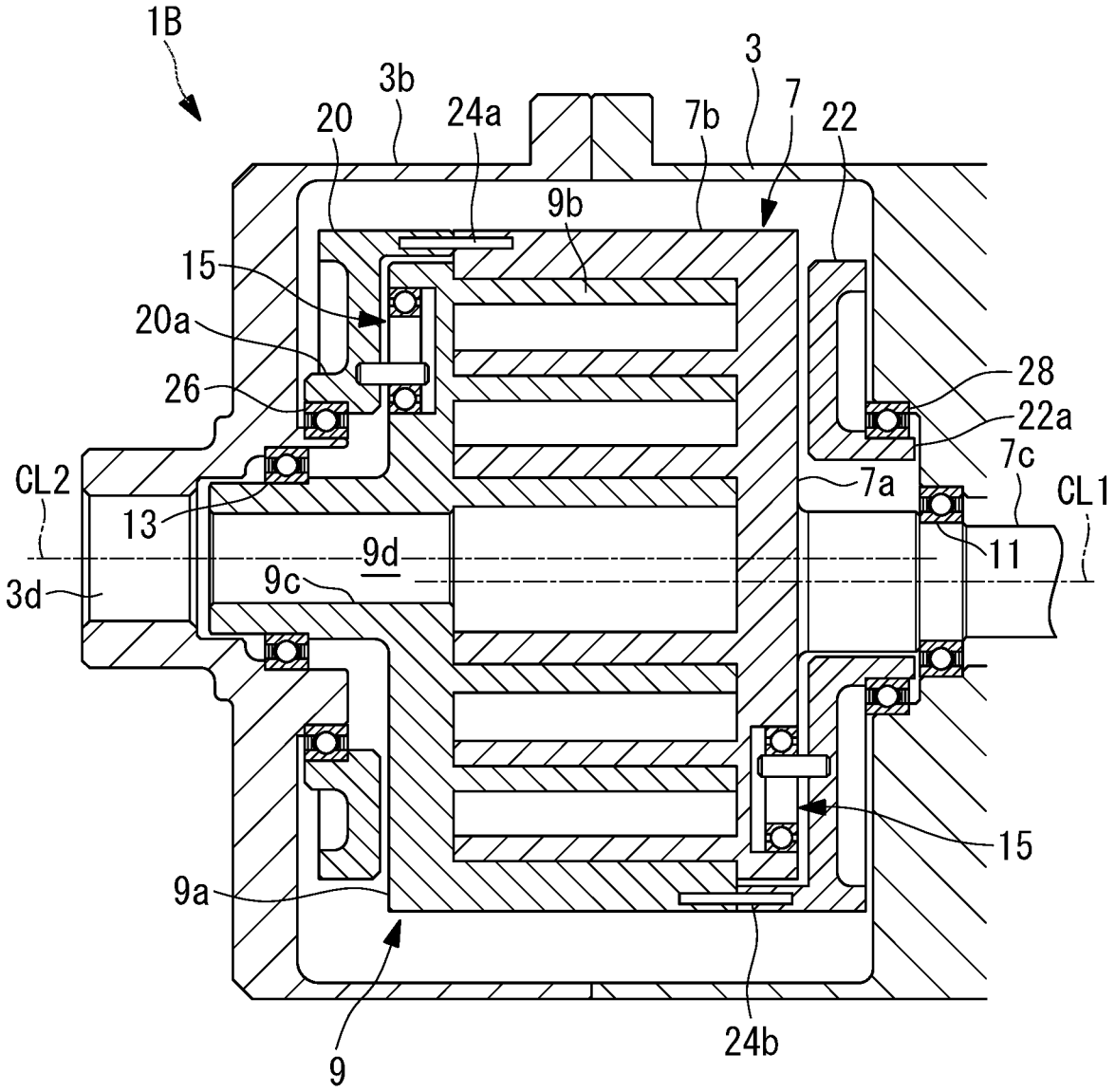
FIG. 4 is a longitudinal cross-sectional view illustrating a co-rotating scroll compressor according to a first modification of FIG. 1.

Further, this embodiment can also be applied to a co-rotating scroll compressor 1B described below. The co-rotating scroll compressor 1B of this modification illustrated in FIG. 4 is different from the co-rotating scroll compressor 1A of the first embodiment in that supporting members 20 and 22 supporting the walls 7*b* and 9*b* of the scroll members 7 and 9 are provided. Other configurations are similar to those in the first embodiment. Therefore, those configurations are denoted by the same reference characters and descriptions thereof are omitted. Note that the periphery of the motor 5 illustrated in FIG. 1 is not illustrated in FIG. 4, but this embodiment also has a similar structure.

As illustrated in FIG. 4, the driving-side supporting member 20 is fixed to the distal end (free end) of the driving-side wall 7*b* of the driving-side scroll member 7 via the fastening member 24*a* such as a pin or a bolt. The driven-side scroll member 9 is sandwiched between the driving-side supporting member 20 and the driving-side scroll member 7. Therefore, the driven-side end plate 9*a* is arranged so as to be opposed to the driving-side supporting member 20.

The driving-side supporting member 20 includes a shaft portion 20*a* on the center side. The shaft portion 20*a* is rotatably attached with respect to the housing 3 via a bearing 26 for the driving-side supporting member that is a ball bearing. As a result, the driving-side supporting member 20 rotates about the driving-side rotational axis CL1 as with the driving-side scroll member 7.

Figure 5:
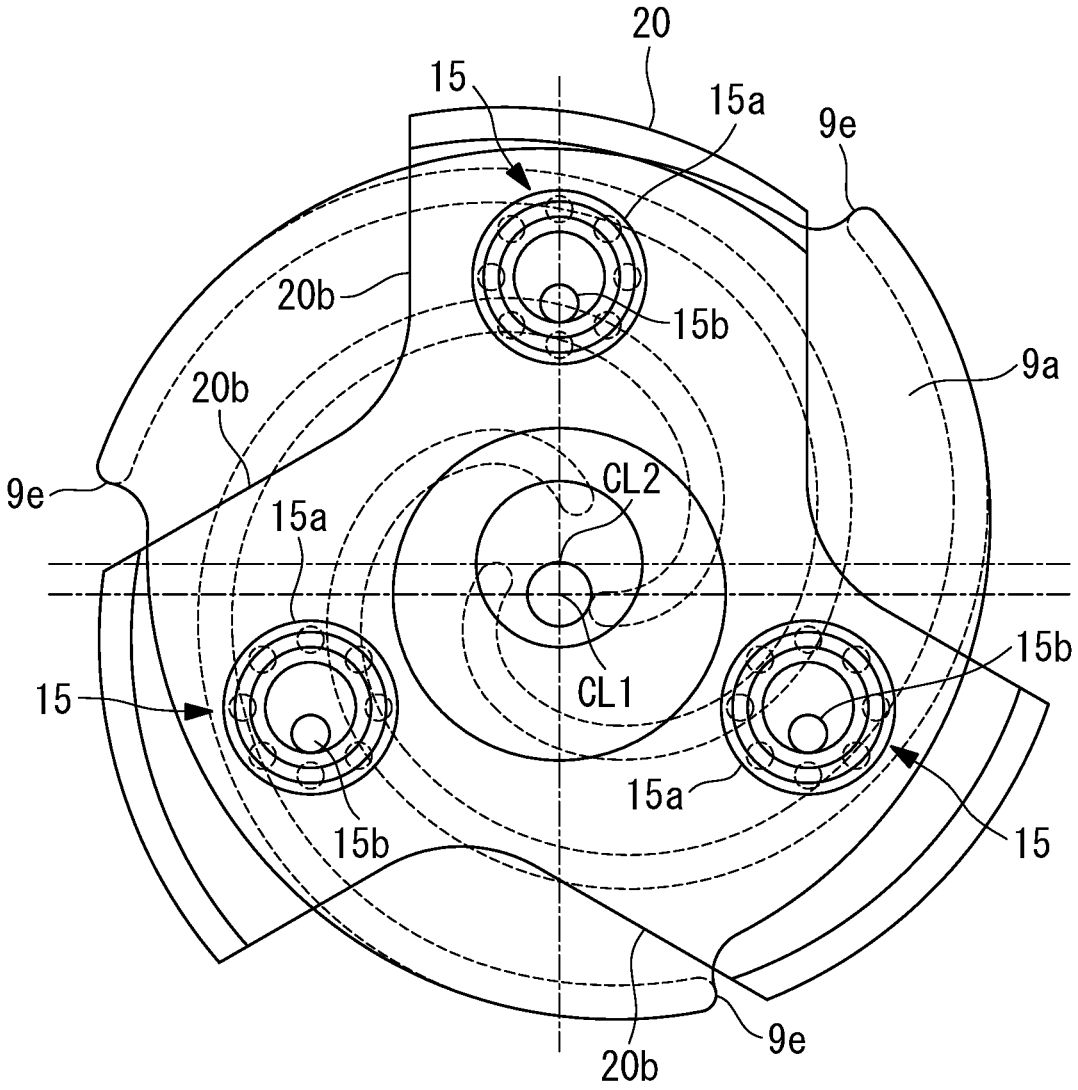
FIG. 5 is a side view of a driving-side supporting member in FIG. 1 seen from the exhaust side.

As illustrated in FIG. 5, the driving-side supporting member 20 includes a radially extending portion 20*b* that extends radially outward to the position of the outer periphery of the driving-side wall 7*b* for each position in which the distal end of the driving-side wall 7*b* is fixed. The region between the radially extending portions 20*b* has a shape that does not extend to the outer periphery side of the driving-side wall 7*b*, and saves weight. In this embodiment, the radially extending portions 20*b* are provided in three directions at equiangular intervals. Note that, in FIG. 5, the driving-side supporting member 20 and the driven-side scroll member 9 are illustrated and the driving-side scroll member 7 is not illustrated.

As illustrated in FIG. 4, the pin ring mechanism 15 is provided between the driving-side supporting member 20 and the driven-side end plate 9*a*. That is, the ring member 15*a* is provided in the driven-side end plate 9*a*, and the pin member 15*b* is provided in the driving-side supporting member 20. As illustrated in FIG. 5, three pin members 15*b* are provided so as to correspond to the positions of the radially extending portions 20*b* of the driving-side supporting member 20. As with the way of thinking described with reference to FIG. 4, the ring member 15*a* provided in the driven-side end plate 9*a* is arranged in a position avoiding the radius connecting the intermediate position between the winding end portions 9*e* of the adjacent driven-side walls 9*b* and the driven-side rotational axis CL2.

The driven-side supporting member 22 is fixed to a distal end (free end) of the driven-side wall 9*b* of the driven-side scroll member 9 via a fastening member 24*b* such as a pin or a bolt. The driving-side scroll member 7 is sandwiched between the driven-side supporting member 22 and the driven-side scroll member 9. Therefore, the driving-side end plate 7*a* is arranged so as to be opposed to the driven-side supporting member 22.

The driven-side supporting member 22 includes a shaft portion 22*a* on the center side. The shaft portion 22*a* is rotatably attached with respect to the housing 3 via a bearing 28 for the driven-side supporting member that is a ball bearing. As a result, the driven-side supporting member 22 rotates about the driven-side rotational axis CL2 as with the driven-side scroll member 9.

Figure 6:
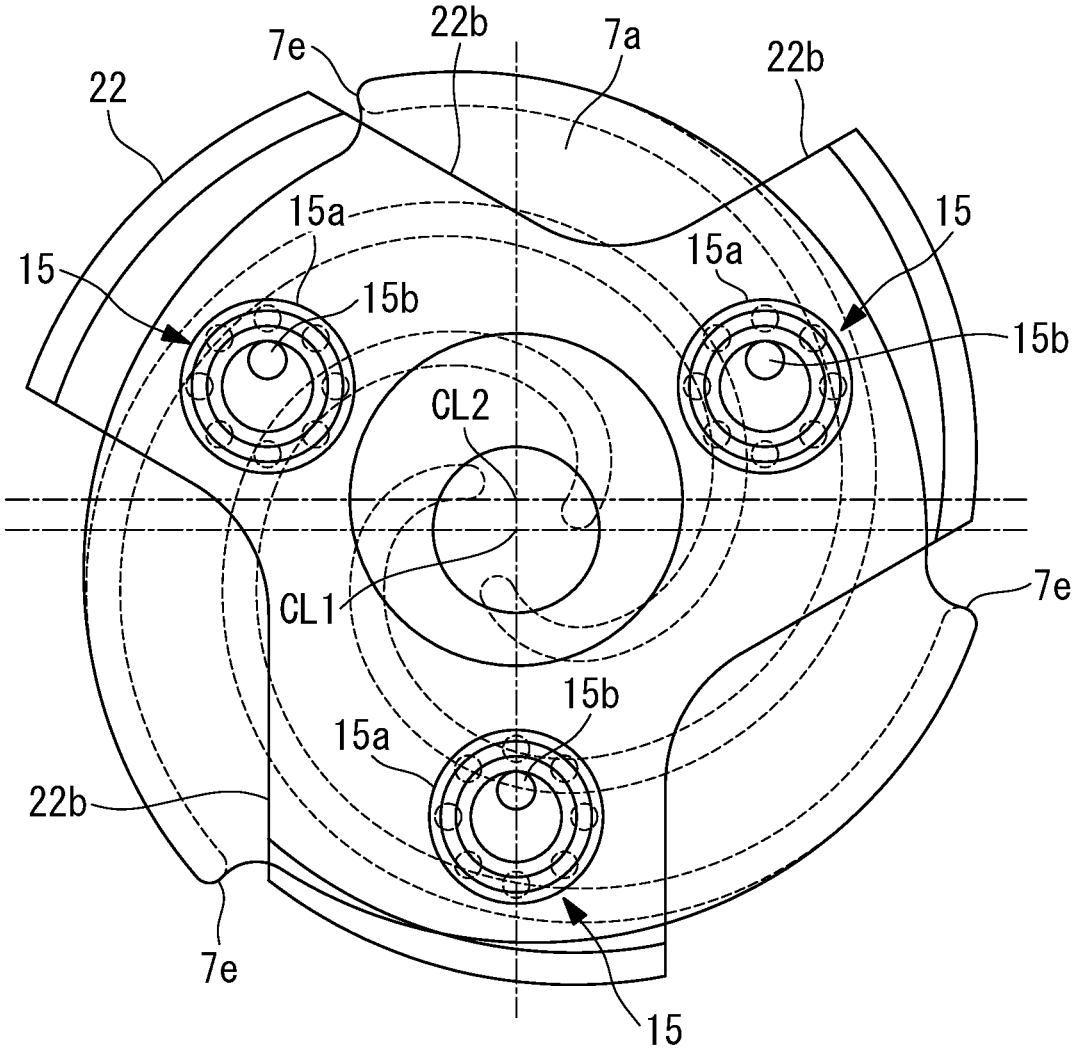
FIG. 6 is a side view of the driven-side supporting member in FIG. 1 seen from the motor side.

As illustrated in FIG. 6, the driven-side supporting member 22 includes a radially extending portion 22*b* that extends radially outward to the position of the outer periphery of the driven-side wall 9*b* for each position in which the distal end of the driven-side wall 9*b* is fixed. The region between the radially extending portions 22*b* has a shape that does not extend to the outer periphery side of the driven-side wall 9*b*, and saves weight. In this embodiment, the radially extending portions 22*b* are provided in three directions at equiangular intervals. Note that, in FIG. 6, the driven-side supporting member 22 and the driving-side scroll member 7 are illustrated, and the driven-side scroll member 9 is not illustrated.

As illustrated in FIG. 4, the pin ring mechanism 15 is provided between the driven-side supporting member 22 and the driving-side end plate 7*a*. That is, the ring member 15*a* is provided in the driving-side end plate 7*a*, and the pin member 15*b* is provided in the driven-side supporting member 22. As illustrated in FIG. 6, three pin members 15*b* are provided so as to correspond to the positions of the radially extending portions 22*b* of the driven-side supporting member 22.

The co-rotating scroll compressor 1B having the above-mentioned configuration operates as follows.

When the driving shaft is rotated about the driving-side rotational axis CL1 by the motor, the driving-side shaft portion 7*c* connected to the driving shaft also rotates. As a result, the driving-side scroll member 7 rotates about the driving-side rotational axis CL1. When the driving-side scroll member 7 rotates, the driving force is transmitted from the driving-side end plate 7*a* to the driven-side supporting member 22 via the pin ring mechanism 15. Further, the driving force is transmitted from the driving-side supporting member 20 to the driven-side end plate 9*a* via the pin ring mechanism 15. As a result, the driving force is transmitted to the driven-side scroll member 9, and the driven-side scroll member 9 rotates about the driven-side rotational axis CL2. At this time, the pin member 15*b* of the pin ring mechanism 15 moves while being in contact with the ring member 15*a*, and hence both of the scroll members 7 and 9 rotationally move in the same direction at the same angular velocity.

When both of the scroll members 7 and 9 rotationally move, the air sucked from the suction opening in the housing 3 is sucked from the outer periphery side of both of the scroll members 7 and 9, and is taken into the compression chamber formed by both of the scroll members 7 and 9. The capacity of the compression chamber decreases as the compression chamber approaches the center side, and air is compressed accordingly. The air compressed as above flows through the exhaust port 9*d* in the driven-side scroll member 9 and is exhausted to the outside from the exhaust opening 3*d* in the housing 3. The exhausted compressed air is guided to an internal combustion engine (not shown) and is used as combustion air.

As in the abovementioned embodiment, the co-rotating scroll compressor 1B according to this modification may have a structure in which the center of gravity is shifted with respect to the walls 7*b* and 9*b*, the end plates 7*a* and 9*a*, and the driving shaft 6. Further, the load by the centrifugal force may be applied to the bearings 26 and 28 by shifting the center of gravity of the supporting members 20 and 22 from the rotation center.

Second Modification

Further, the abovementioned embodiment can also be applied to a co-rotating scroll compressor 1C described below.

Figure 7:
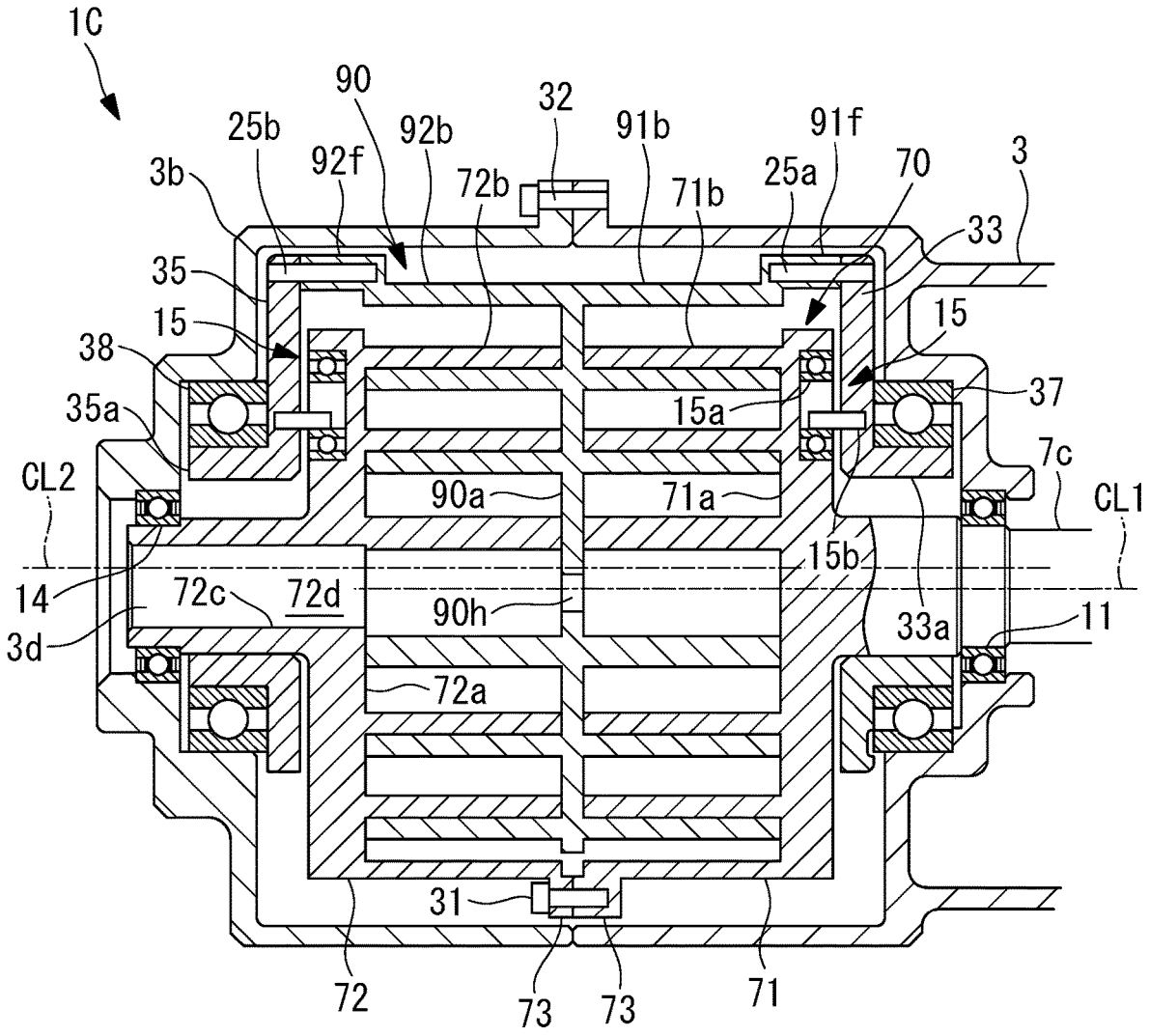
FIG. 7 is a longitudinal cross-sectional view illustrating a co-rotating scroll compressor according to a second modification of FIG. 1.

FIG. 7 illustrates a co-rotating scroll compressor 1C according to this modification. Note that structures similar to those in the co-rotating scroll compressor 1A described with reference to FIG. 1 are the same denoted by the same reference character, and the description thereof is omitted.

As illustrated in FIG. 7, the driving-side scroll member 70 includes a first driving-side scroll portion 71 on the motor side (the right side in FIG. 7) and a second driving-side scroll portion 72 on the exhaust opening 3*d* side.

The first driving-side scroll portion 71 includes a first driving-side end plate 71*a* and a first driving-side wall 71*b*. Three lines of first driving-side walls 71*b* are provided as with the abovementioned driving-side walls 7*b* (see FIG. 2).

The second driving-side scroll portion 72 includes a second driving-side end plate 72*a* and a second driving-side wall 72*b*. Three lines of second driving-side walls 72*b* are provided as with the abovementioned driving-side walls 7*b* (see FIG. 2). A second driving-side shaft portion 72*c* that extends in the direction of the driving-side rotational axis CL1 is connected to the second driving-side end plate 72*a*. The second driving-side shaft portion 72*c* is provided so as to be rotatable with respect to the housing 3 via a second driving-side bearing 14 that is a ball bearing. An exhaust port 72*d* is formed in the second driving-side shaft portion 72*c* along the driving-side rotational axis CL1.

The first driving-side scroll portion 71 and the second driving-side scroll portion 72 are fixed in a state in which the distal ends (free ends) of the walls 71*b* and 72*b* are facing each other. The first driving-side scroll portion 71 and the second driving-side scroll portion 72 are fixed by a bolt (wall fixing portion) 31 fastened with respect to flange parts 73 provided in a plurality of places so as to protrude radially outward.

The driven-side scroll member 90 includes a driven-side end plate 90*a* provided in substantially the middle in the axial direction (the horizontal direction in FIG. 7). A through hole (not shown) is formed in the middle of the driven-side end plate 90*a*, and air that has been compressed flows to the exhaust port 72*d*.

Driven-side walls 91*b* and 92*b* are provided on both sides of the driven-side end plate 90*a*. The first driven-side wall 91*b* provided from the driven-side end plate 90*a* to the motor side is engaged with the first driving-side wall 71*b* of the first driving-side scroll portion 71, and the second driven-side wall 92*b* provided from the driven-side end plate 90*a* to the exhaust opening 3*d* side is engaged with the second driving-side wall 72*b* of the second driving-side scroll portion 72.

A first supporting member 33 and a second supporting member 35 are provided on both ends of the driven-side scroll member 90 in the axial direction (the horizontal direction in FIG. 7). The first supporting member 33 is arranged on the motor side (the right side in FIG. 7), and the second supporting member 35 is arranged on the exhaust opening 3*d* side. The first supporting member 33 is fixed to a first fixing portion 91*f* on the distal end (free end) of the first driven-side wall 91*b* by a fastening member 25*a* such as a pin or a bolt, and the second supporting member 35 is fixed to a second fixing portion 92*f* on the distal end (free end) of the second driven-side wall 92*b* by a fastening member 25*b* such as a pin or a bolt. As with the driven-side fixing portion 9*f* described with reference to FIG. 3, the fixing portions 91*f* and 92*f* provided on the driven-side walls 91*b* and 92*b* are bulging portions obtained by increasing the board thickness of the driven-side walls 91*b* and 92*b* radially outward, and are in positions separated from the winding end portions in the inner circumferential direction (winding starting direction) of the driven-side walls 91*b* and 92*b*.

A shaft portion 33*a* is provided on the central axis side of the first supporting member 33, and the shaft portion 33*a* is fixed to the housing 3 via a bearing 37 for the first supporting member. A shaft portion 35*a* is provided on the central axis side of the second supporting member 35, and the shaft portion 35*a* is fixed to the housing 3 via a bearing 38 for the second supporting member. As a result, the driven-side scroll member 90 is rotated about the second center axis CL2 via the supporting members 33 and 35. Further, the shapes of the supporting members 33 and 35 are similar to that of the driven-side supporting member 22 in the first embodiment described with reference to FIG. 6.

The pin ring mechanism 15 is provided between the first supporting member 33 and the first driving-side end plate 71*a*. That is, the ring member 15*a* is provided in the first driving-side end plate 71*a*, and the pin member 15*b* is provided in the first supporting member 33. As illustrated in FIG. 6, three pin members 15*b* are provided so as to correspond to the positions of the supporting portions of the first supporting member 33.

The pin ring mechanism 15 is provided between the second supporting member 35 and the second driving-side end plate 72*a*. That is, the ring member 15*a* is provided in the second driving-side end plate 72*a*, and the pin member 15*b* is provided in the second supporting member 35. As illustrated in FIG. 6, three pin members 15*b* are provided so as to correspond to the positions of the supporting portions of the second supporting member 35.

The scroll accommodation portion 3*b* of the housing 3 is divided at the substantially middle portion of the scroll members 70 and 90 in the axial direction, and fixed by a bolt 32.

The co-rotating scroll compressor 1C having the abovementioned configuration operates as follows.

When the driving shaft connected to a rotor is rotated about the driving-side rotational axis CL1 by a motor, the driving-side shaft portion 7*c* connected to the driving shaft also rotates. As a result, the driving-side scroll member 70 rotates about the driving-side rotational axis CL1. When the driving-side scroll member 70 rotates, the driving force is transmitted from the supporting members 33 and 35 to the driven-side scroll member 90 via the pin ring mechanism 15, and the driven-side scroll member 90 rotates about the driven-side rotational axis CL2. At this time, the pin member 15*b* of the pin ring mechanism 15 moves while being in contact with the ring member 15*a*, and hence both of the scroll members 70 and 90 rotationally move in the same direction at the same angular velocity.

When both of the scroll members 70 and 90 rotationally move, the air sucked from the suction opening in the housing 3 is sucked from the outer periphery side of both of the scroll members 70 and 90, and is taken into the compression chamber formed by both of the scroll members 70 and 90. Further, the compression chamber formed by the first driving-side wall 71*b* and the first driven-side wall 91*b* and the compression chamber formed by the second driving-side wall 72*b* and the second driven-side wall 92*b* are separately compressed. The capacity of the compression chambers decreases as the compression chambers approach the center side, and the air is compressed accordingly. The air compressed by the first driving-side wall 71*b* and the first driven-side wall 91*b* flows through a through hole 90*h* formed in the driven-side end plate 90*a*, and is merged with air compressed by the second driving-side wall 72*b* and the second driven-side wall 92*b*. The merged air flows through the exhaust port 72*d* and is exhausted to the outside from the exhaust opening 3*d* in the housing 3. The exhausted compressed air is guided to an internal combustion engine (not shown) and is used as combustion air.

As in the abovementioned embodiment, the co-rotating scroll compressor 10 according to this modification may have a structure in which the center of gravity is shifted with respect to the walls 71*b*, 72*b*, 91*b*, and 92*b*, the end plates 71*a*, 72*a*, and 90*a*, and the driving shaft 6. Further, the load by the centrifugal force may be applied to the bearings 37 and 38 by shifting the center of gravity of the supporting members 33 and 35 from the rotation center.

Note that, in the abovementioned embodiments, the co-rotating scroll compressor is used as the supercharger, but the present invention is not limited thereto, and the co-rotating scroll compressor can be widely used as long as fluid is compressed. For example, the co-rotating scroll compressor can be used as a refrigerant compressor used in an air conditioning unit.

Further, the pin ring mechanism 15 is used as a synchronous driving mechanism, but the present invention is not limited thereto, and the pin ring mechanism 15 may be used as a crank pin mechanism, for example.

REFERENCE SIGNS LIST

1A, 1B, 1C co-rotating scroll compressor housing
3*a* motor accommodation portion
3*b* scroll accommodation portion
3*c* cooling fin
3*d* exhaust opening
5 motor (drive unit)
5*a* stator
5*b* rotor
6 driving shaft
7 driving-side scroll member
7*a* driving-side end plate
7*b* driving-side wall
7*c* driving-side shaft portion
7*e* winding end portion
9 driven-side scroll member
9*a* driven-side end plate
9*b* driven-side wall
9*c* driven-side shaft portion
9*d* exhaust port
9*e* winding end portion
11 driving-side bearing
13 driven-side bearing
15 pin ring mechanism (synchronous driving mechanism)
15*a* ring member
15*b* pin member
20 driving-side supporting member
20*a* shaft portion
20*b* radially extending portion
22 driven-side supporting member
22*a* shaft portion
22*b* radially extending portion
24*a* fastening member
24*b* fastening member
25*a* fastening member
25*b* fastening member
26 bearing for driving-side supporting member
28 bearing for driven-side supporting member
31 bolt (wall fixing portion)
32 bolt
33 first supporting member
33*a* shaft portion
35 second supporting member
35*a* shaft portion
37 bearing for first supporting member
38 bearing for second supporting member
70 driving-side scroll member
71 first driving-side scroll portion
71*a* first driving-side end plate
71*b* first driving-side wall
72 second driving-side scroll portion
72*a* second driving-side end plate
72*b* second driving-side wall
72*c* second driving-side shaft portion
72*d* exhaust port
73 flange part
90 driven-side scroll member
90*a* driven-side end plate
90*h* through hole
91*b* first driven-side wall
92*b* second driven-side wall

The invention claimed is:

1. A co-rotating scroll compressor, comprising:

a driving shaft driven by a drive unit so as to rotate;

a driving-side scroll member connected to the driving shaft, and including a plurality of spiral driving-side walls provided about a center of a driving-side end plate at predetermined angular intervals;

a driven-side scroll member including spiral driven-side walls, the driven-side walls being provided about a center of a driven-side end plate at predetermined angular intervals and in a number corresponding to the driving-side walls, the driven-side walls being engaged with the corresponding driving-side walls so as to form a compression space;

a synchronous driving mechanism provided between the driving-side scroll member and the driven-side scroll member, the synchronous driving mechanism synchronously transmitting driving force from the driving-side scroll member to the driven-side scroll member so that the driving-side scroll member and the driven-side scroll member rotationally move in a same direction at a same angular velocity;

a driving-side bearing that rotatably supports the driving-side scroll member; and a driven-side bearing that rotatably supports the driven-side scroll member, wherein:

a center of gravity of at least one of the driving shaft, the driving-side scroll member, and the driven-side scroll member is shifted from a rotation center by a predetermined distance, the predetermined distance being set so that a total bearing load obtained by centrifugal force and fluid compression that is 5% or more of a dynamic load rating of at least one of the driving-side bearing and the driven-side bearing or more is generated;

a driving-side supporting member arranged across the driven-side end plate, fixed to distal end sides of the driving-side walls in a rotating shaft direction, and the synchronous driving mechanism including a pin that engages the driven-side end plate to rotate the driven-side scroll member together with the driving-side scroll member; and a driven-side supporting member arranged across the driving-side end plate, fixed to distal end sides of the driven-side walls in a rotating shaft direction, and the synchronous driving mechanism including a pin that engages the driving-side end plate to rotate the driving-side scroll member together with the driven-side scroll member, wherein a center of gravity of at least one of the driving-side supporting member and the driven-side supporting member is shifted from a rotation center.

2. The co-rotating scroll compressor according to claim 1, wherein the predetermined distance is set so that a load to which a preload applied to at least one of the driving-side bearing and the driven-side bearing is added is 5% of the dynamic load rating or more.

3. The co-rotating scroll compressor according to claim 1, wherein at least one of the plurality of driving-side walls and the plurality of driven-side walls is shifted from a position that is symmetrical to a rotation center.

4. A method for designing a co-rotating scroll compressor, the co-rotating scroll compressor including:

a driving shaft driven by a drive unit so as to rotate;

a driving-side scroll member connected to the driving shaft, and including a plurality of spiral driving-side walls provided about a center of a driving-side end plate at predetermined angular intervals;

a driven-side scroll member including spiral driven-side walls, the driven-side walls being provided about a center of a driven-side end plate at predetermined angular intervals and in a number corresponding to the driving-side walls, the driven-side walls being engaged with the corresponding driving-side walls so as to form a compression space;

a synchronous driving mechanism that transmits driving force from the driving-side scroll member to the driven-side scroll member so that the driving-side scroll member and the driven-side scroll member rotationally move in a same direction at a same angular velocity;

a driving-side bearing that rotatably supports the driving-side scroll member;

a driven-side bearing that rotatably supports the driven-side scroll member;

a driving-side supporting member arranged across the driven-side end plate, fixed to distal end sides of the driving-side walls in a rotating shaft direction, and the synchronous driving mechanism including a pin that engages the driven-side end plate to rotate the driven-side scroll member together with the driving-side scroll member, and a driven-side supporting member arranged across the driving-side end plate, fixed to distal end sides of the driven-side walls in a rotating shaft direction, and the synchronous driving mechanism including a pin that engages the driving-side end plate to rotate the driving-side scroll member together with the driven-side scroll member, wherein a center of gravity of at least one of the driving-side supporting member and the driven-side supporting member is shifted from a rotation center, the method comprising:

shifting a center of gravity of at least one of the driving shaft, the driving-side scroll member, and the driven-side scroll member from a rotation center by a predetermined distance; and setting the predetermined distance so that a total bearing load obtained by centrifugal force and fluid compression that is 5% or more of a dynamic load rating of at least one of the driving-side bearing and the driven-side bearing or more is generated.

* * * * *